United States Patent [19]

Cowan, Jr.

[11] Patent Number: 4,852,705

[45] Date of Patent: Aug. 1, 1989

[54] CASE WITH EXTENDABLE WHEELS AND HANDLE

[76] Inventor: Samuel C. Cowan, Jr., Route 2, Box 94, Granbury, Tex. 76048

[21] Appl. No.: 223,165

[22] Filed: Jul. 22, 1988

[51] Int. Cl.[4] ..... A45G 5/14

[52] U.S. Cl. ..... 190/18 A; 280/37

[58] Field of Search ..... 190/18 A; 280/37

[56] References Cited

U.S. PATENT DOCUMENTS

| | | | |
|---|---|---|---|
| 4,575,109 | 3/1986 | Cowdery | 190/18 A |
| 4,588,055 | 5/1986 | Chen | 190/18 A |
| 4,773,123 | 9/1988 | Yu | 190/18 A |

FOREIGN PATENT DOCUMENTS

| | | | |
|---|---|---|---|
| 839689 | 5/1952 | Fed. Rep. of Germany | 190/18 A |
| 867582 | 8/1941 | France | 190/18 A |
| 1145985 | 5/1957 | France | 190/18 A |
| 1444998 | 8/1976 | United Kingdom | 190/18 A |

*Primary Examiner*—William Price

*Attorney, Agent, or Firm*—Arthur F. Zobal

[57] ABSTRACT

The case has a self-contained handle and wheels which can be extended for rolling the case along or retracted for stowing the case. The wheels are mounted to framework inside of the case by a mounting rod, which rod turns to move the wheels between the stowed and the deployed positions. The handle is also coupled to the framework and can be extended from a stowed position inside of the case to a deployed position outside of the case. The handle is coupled to the wheel mounting rod through a linkage rod which turns the mounting rod. As the handle is extended to the deployed position, the linkage rod turns the mounting rod to deploy the wheels. The wheels are stowed into the case by stowing the handle.

5 Claims, 7 Drawing Sheets

CASE WITH EXTENDABLE WHEELS AND HANDLE

FIELD OF THE INVENTION

The present invention relates to cases of the type that can be moved along on wheels. Such cases are typically used to contain articles of clothing or equipment for travel.

BACKGROUND OF THE INVENTION

Airline crew members regularly travel on overnight trips. As such, each crew member needs a case for his overnight personal effects. Passengers also require cases for their possessions. It is preferable to have a case mounted on wheels so that it can be rolled along when walking instead of carried. It is also preferable for the case to have self-contained wheels and a self-contained handle so that the case could be easily stowed when the wheels and handle are retracted. Although there are existing wheelable devices that allow a case to be rolled along, I am not aware of any prior art devices that are self-contained within a case.

SUMMARY OF THE INVENTION

It is an object of the present invention to provide a case with a self-contained handle and wheels that are extendable and retractable.

It is a further object of the present invention to provide a case with a handle and wheels that are easy to manipulate to either the extended or retracted position.

The case of the present invention comprises roller means for allowing the case to be rolled thereupon when deployed, mounting means for mounting the roller means to a framework in the case, and handle means for facilitating movement of the case on the roller means. The mounting means allows the roller means to move between stowed and deployed positions. In the stowed position, the roller means is located inside of openings formed by structure of the case, and in the deployed position the roller means extend out of the openings of the case. The handle means is coupled to the mounting means by way of linkage means, wherein deployment of the handle means causes the deployment of the roller means and stowage of the handle means causes stowage of the roller means. The case has opening means for receiving the handle means.

In one aspect of the invention, the roller means comprises plural wheels. In another aspect, the mounting means comprises a rod with plural sets of flanges extending therefrom. The sets of flanges make up forks that receive the respective wheels. The linkage means comprises a linkage rod oriented transversely to the mounting means rod so as to turn the mounting means rod about its longitudinal axis to deploy and stow the wheels.

In still another aspect the handle means and wheels are maintained in their deployed positions by releasable locking means. When the handle means is in the stowed position, the wheels are maintained in the stowed position by spring bias means coupled to the mounting means rod and the framework.

DESCRIPTION OF PREFERRED EMBODIMENT

The case of the present invention has self-contained wheels and a self-contained handle, both of which can be extended outwardly from stowed hidden positions. The operator need only manipulate the position of the handle, because the handle acts to manipulate the position of the wheels. The wheels are deployed to their outward extended position by extending the handle outwardly from the case. With the wheels and the handle so deployed, the case can be easily rolled along on the wheels by someone grasping the handle. The handle and wheels are stowed back to their hidden positions by pushing the handle back into the case.

Figure 2:
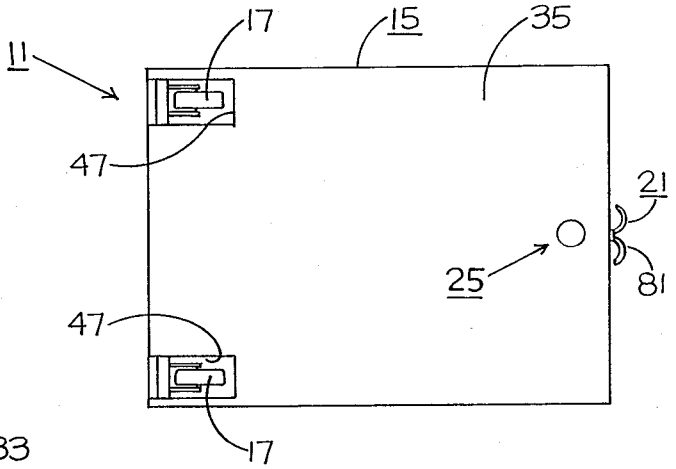
FIG. 2 is a schematic plan view of the bottom side of the case, with the handle and the wheels retracted.
Figure 1:
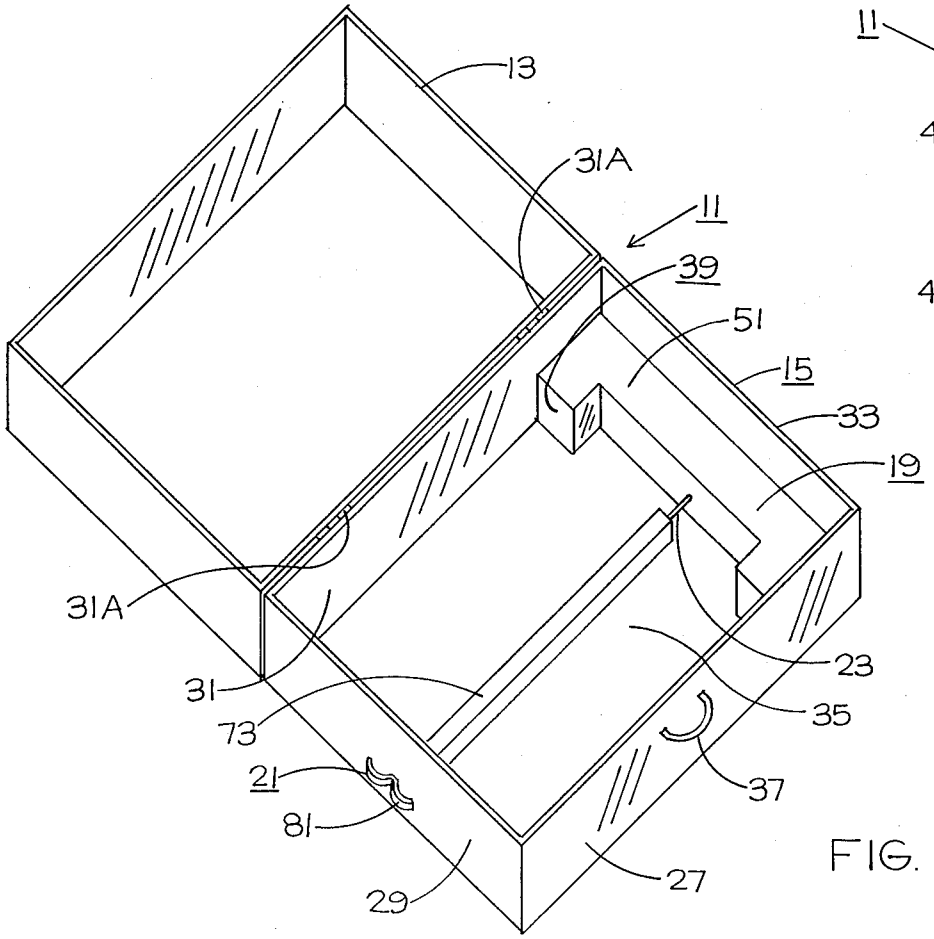
FIG. 1 is a schematic isometric view of the case of the present invention, in accordance with a preferred embodiment.

In FIG. 1 there is shown a schematic isometric view of the case 11 of the present invention, in accordance with a preferred embodiment. The case 11 includes first and second case portions 13, 15, wheels 17 (see FIG. 2), a mounting apparatus and housing 19 for the wheels, a handle 21, a linkage 23 between the handle and the wheel mounting apparatus, and a handle locking apparatus 25 (see FIG. 4).

The first and second case portions 13, 15 are basically identical. The second case portion 15 houses the extendable wheels 17 and handle 21, and their associated mounting apparatuses. As such, the second case portion 15 forms the bottom of the case with the first case portion 13 forming the top or lid. Because of the similarity between the first and second case portions, only the second case portion 15 will be described hereinbelow. The second case portion 15 is a rectangular box with an open top. The case portion 15 has first, second, third, and fourth side walls 27, 29, 31, 33 and a back wall 35. The walls preferably are made of a suitable plastic and form a rigid framework, upon which the wheels 17 and the handle 21 are mounted. Although in the preferred embodiment the case 11 is relatively rigid, in other embodiments of the present invention, the case could be formed of a flexible material surrounding a rigid framework that joins the wheels to the handle. The first and second case portions 13, 15 are hinged together by hinges 31A secured to the edges of corresponding side walls 31, thereby allowing the case portions to swing between open and closed positions. A fixed handle strap 37 is attached to the outside of the second case portion.

Figure 5:
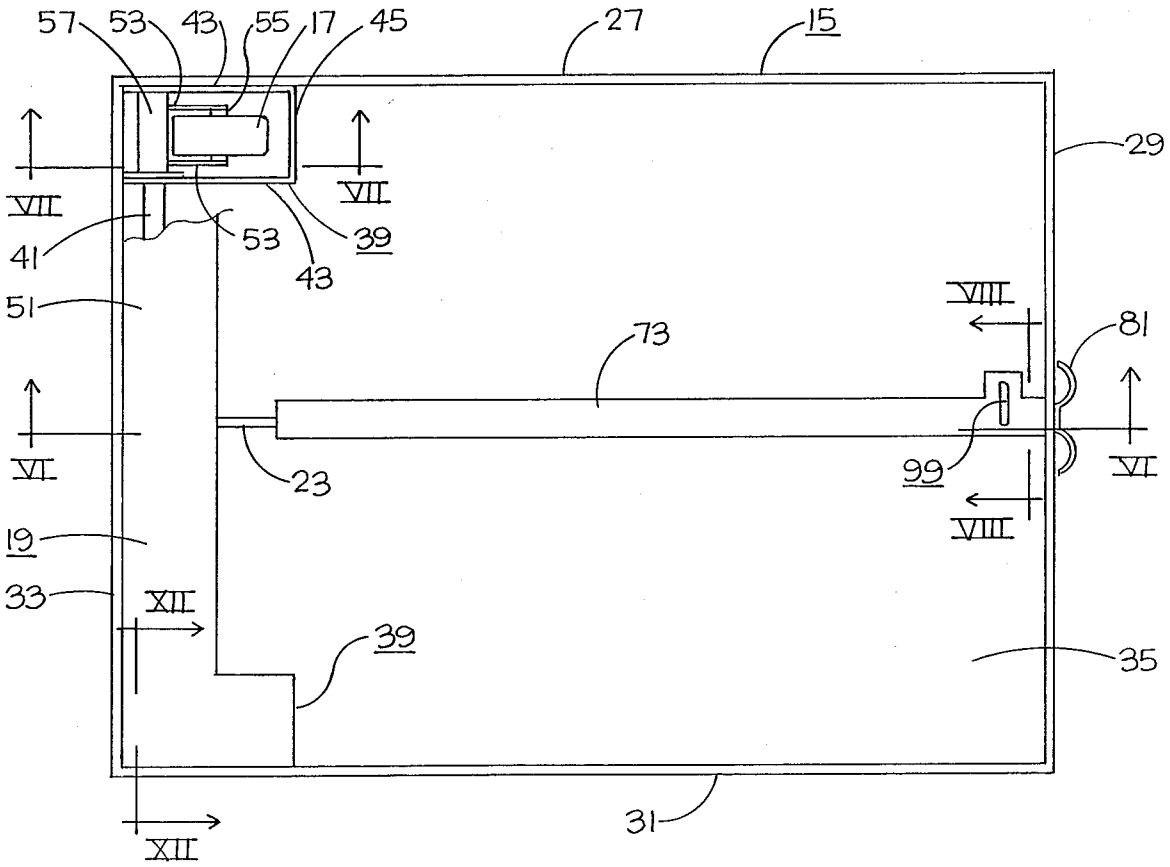
FIG. 5 is a schematic partial cut away plan view of the second case portion shown with the handle in the stowed position.
Figure 12:
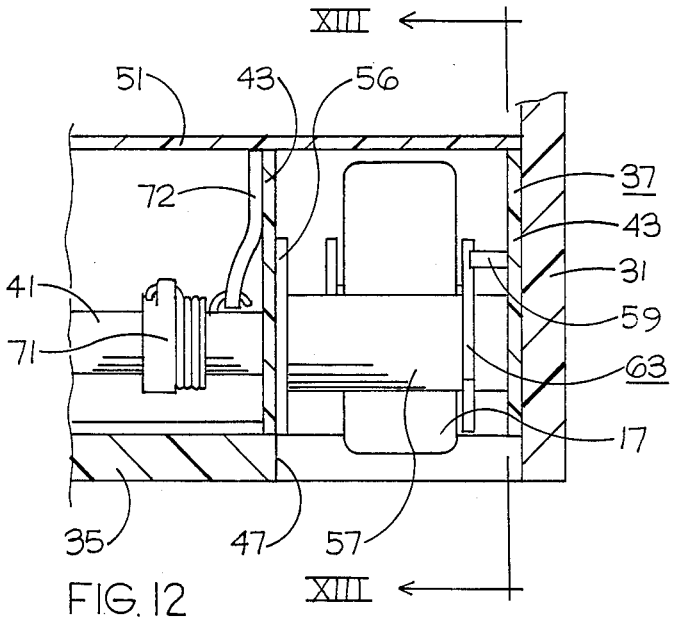
FIG. 12 is a schematic cross-sectional view taken at lines XII—XII of FIG. 5.

In the preferred embodiment, the case 11 has two extendable wheels 17 which are mounted to the case portion 15 by the wheel mounting apparatus 19. The wheel mounting apparatus 19 includes a wheel well 39 for each wheel 17 and a rod 41 extending between the wheel wells. Referring to FIGS. 1, 5, and 12, each wheel well is made up of a U-shaped member (formed of a suitable plastic) having two parallel side walls 43 and an end wall 45. The wheel wells 39 are positioned in respective corners of the case portion 15 along the fourth side wall 33, and are oriented such that the side walls 43 of the U-shaped members are perpendicular to the back wall 35 of the case portion and the open ends of the U-shaped members face the fourth side wall 33. Rectangular openings 47 (see FIG. 2) are formed into the case portion back wall 35 to correspond with the respective gaps between the side walls 43 of the U-shaped members. These back wall openings 47 allow the wheels 17 to pass in and out of the wheel wells of the case. The wheel wells 39 are secured to the walls 33 and 35 of the case portion by bonding or by suitable brackets (not shown). A top plate 51 (of suitable plastic) connects the wheel wells 39 together by coupling to the top portion of the U-shaped members.

The rod 41 extends through both of the side walls 43 of both of the wheel wells 39 so as to be parallel to the fourth side wall 33 of the case portion 15. The rod 41 extends through circular openings (not shown) in the wheel well side-walls 43. Bearings (not shown) located in the openings in the wheel well side walls 43 support the rod 41 and allow the rod to rotate about its longitudinal axis. Located in each wheel well 39 is a mounting cylinder 57 which has one of its ends attached to a plate 56. The plates 56 couple the respective mounting cylinders 57 to the rod 41: each plate has a circular aperture formed therethrough for snugly receiving an end portion of the rod 41. The rod 41 extends all the way through the respective mounting cylinder 57. The mounting cylinders 57 are coupled to the rod 41 by set screws 58 such that the mounting cylinders rotate with the rod. Each mounting cylinder 57 extends from one wheel well side wall 43 to the other side wall so as to maintain the longitudinal position of the rod relative to the wheel wells 39. Each wheel 17 is coupled to one of the respective mounting cylinders 57 by a pair of parallel wheel flanges 53 which extend radially from the mounting cylinders 57 (see FIGS. 5 and 7). The wheel flanges 53 form a fork for receiving portions of the respective wheels 17 and for supporting the respective wheel axle 55 around which each wheel 17 rotates.

Figure 11:
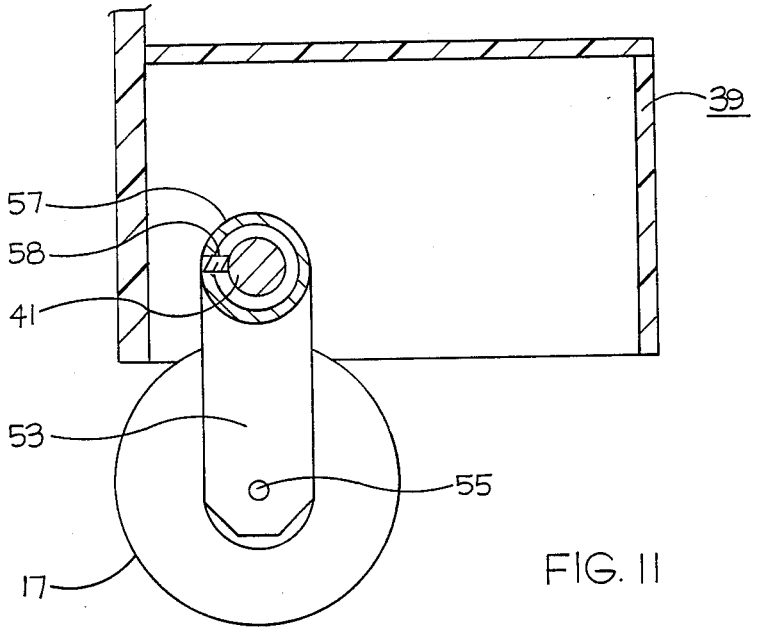
FIG. 11 is a schematic cross-sectional view similar to FIG. 7, but showing the wheel in the deployed position.
Figure 13:
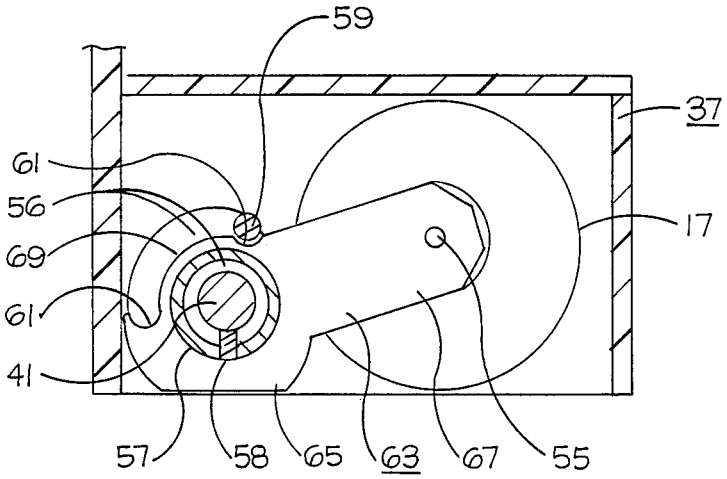
FIG. 13 is a schematic cross-sectional view taken at lines XIII—XIII of FIG. 12.

As the rod 41 turns, the wheels 17 are moved from a stowed position inside of the wheel wells 39 (see FIG. 7) to a deployed position outside of the wheel wells (see FIG. 11). The range of motion of the rod 41 and wheels 17 are limited by a stop peg 59 and stop surfaces 61 (see FIGS. 12 and 13) on a modified wheel flange 63. The modified wheel flange 63 has a generally circular portion 65 that encircles the respective mounting cylinder 57 and a generally rectangular portion 67 that projects radially outward from the circular portion to receive the respective wheel axle 55. The circular portion 65 of the flange 63 has an arcuate notch 69, with the extent of the arc bounded by the stop surfaces 61. The arcuate distance between the stop surfaces 61 is approximately 90 degrees. The stop surfaces 61 abut against the stop peg 59, which projects perpendicularly from the adjacent wheel well side wall 43, when the wheels are in either the stowed or deployed positions. The stop peg 59 and stop surfaces 61 limit the range of motion of the wheels 17 between the stowed position and the deployed position. In the deployed position, the wheel 17 is positioned outside of the wheel well 39 such that an imaginary line extending through the centers of the rod 41 and the wheel axle 55 is perpendicular to the case portion back wall 35 (see FIG. 11).

The wheels 17 are kept biased in the stowed position by a coil spring 71 (see FIG. 12). The spring 71 is located around one end of the rod 41 outside of the associated wheel well, where it has one end coupled to the rod 41 and the other end coupled to member 72 which in turn is connected to the wall 43. The wheels 17 and rod 41 may be moved to the deployed position by using sufficient force to overcome the spring 71.

Figure 6:
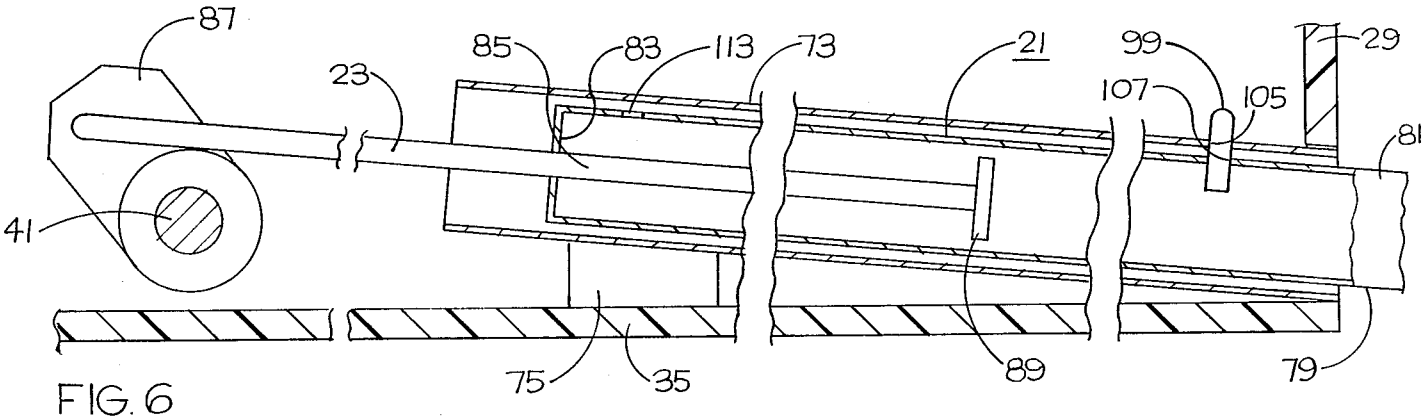
FIG. 6 is a schematic cross-sectional view taken through lines VI—VI of FIG. 5, showing the handle in the stowed position.

Referring to FIGS. 1, 5, and 6, the handle 21 is contained within a hollow housing tube 73. The handle housing 73 is mounted to the case portion back wall 35 by brackets 75 so that the handle housing extends perpendicularly to the rod 41. The handle housing 73 extends from a position near the rod 41 to the second side wall 29 where it is received by an opening 77 in the side wall.

The handle 21 is a hollow tube that slides longitudinally inside of the housing 73. The end 79 of the handle that is furtherest from the rod 41 has a handle grip 81 and is located outside of the case 11. The other end 83 of the handle is located inside of the handle housing 73 and is closed with the exception of a small coaxial hole 85. The hole 85 receives a linkage rod 23 which extends from the rod 41 to some point inside of the handle 21. The linkage rod 23 is coupled to the rod 41 by a radially extending linkage flange 87, which flange is fixedly coupled to the rod 41. The flange 87 has an aperture 88 formed therethrough for receiving a transverse end portion 23A of the rod 23 such that the linkage rod can pivot relative to the linkage flange. As shown in FIG. 6, the handle housing 73 is inclined relative to the case portion back wall 35 wherein the housing extends away from the back wall as the housing approaches the rod 41. The inclination of the housing allows the linkage rod 23 to couple to the linkage flange 87. The end of the linkage rod 23 contained within the handle 21 has a flattened head 89 of greater diameter than the diameter of the hole 85 in the closed end 83 of the handle 21 to prevent the end of the linkage rod from exiting the handle through the hole. The length of the linkage rod 23 is such that the head 89 of the linkage rod 41 is located close to the second side wall 29 when the handle 21 is in the stowed position. As will be explained hereinbelow, this position of the linkage rod head 89 requires near full extension of the handle 21 before the wheels 12 are deployed.

Figure 3:
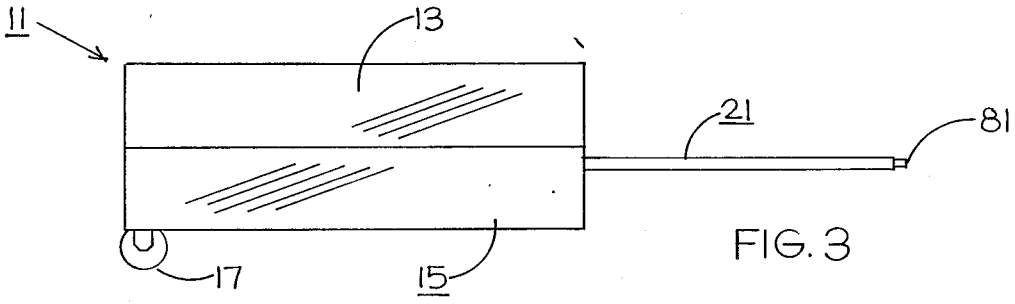
FIG. 3 is a schematic elevational view of the case with the handle and the wheels deployed to an extended position.
Figure 4:
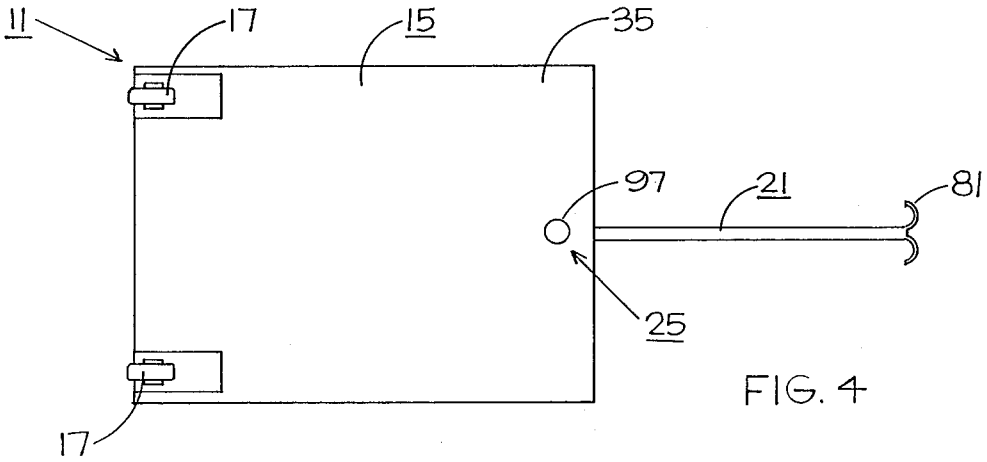
FIG. 4 is a schematic plan view of the bottom side of the case of FIG. 3.
Figure 7:
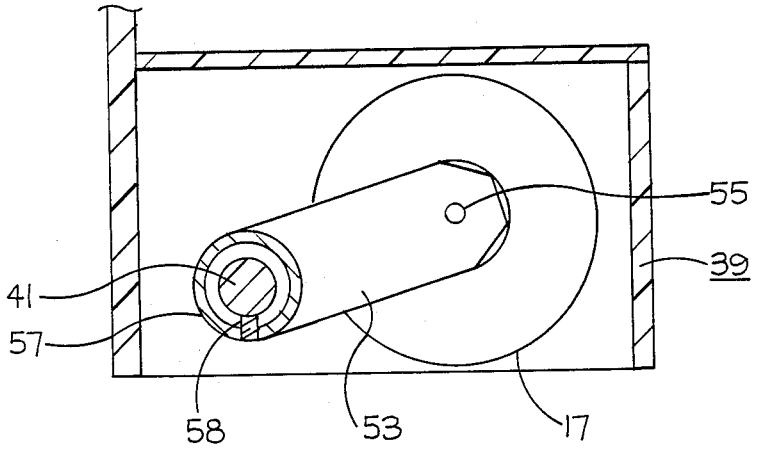
FIG. 7 is a schematic cross-sectional view taken along lines VII—VII of FIG. 5, showing the wheel in the stowed position.
Figure 10:
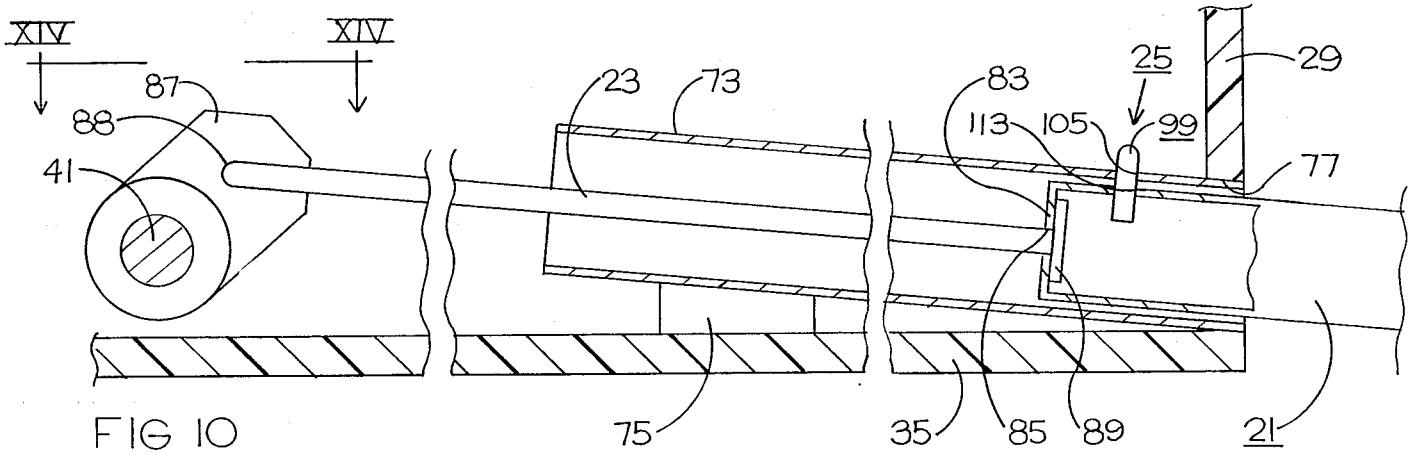
FIG. 10 is a schematic cross-sectional view similar to FIG. 6, but showing the handle extended outwardly.
Figure 14:
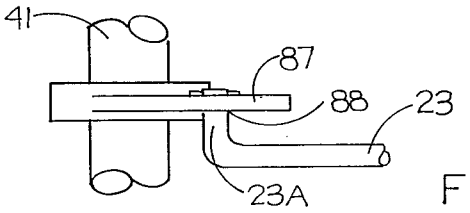
FIG. 14 is a partial view of FIG. 13 as seen along lines XIV—XIV thereof.

The operation of the extendable handle and wheels will now be described. FIGS. 6 and 7 show the handle 21 and wheels 17 in the stowed position. To deploy the handle 21 and wheels 17, the case 11 is stood upon the fourth side wall 33 and the handle is pulled upwardly. As the handle 21 nears its full outward extension, the closed end 83 of the handle 21, which has been sliding along the linkage rod 23, engages the head 89 of the linkage rod 23 and causes the linkage rod to move longitudinally towards the second side wall 29 (see FIG. 10). The movement of the linkage rod 23 causes the rod 41, via the linkage flange 87, to turn clockwise, as seen in FIGS. 6 and 10, thereby deploying the wheels 17 out from the wheel wells 39. FIGS. 3 and 4 show the case 11 with the handle 21 and wheels 17 extended. To stow the handle and wheels, the handle 21 is pushed back inside of the case, wherein the closed end 83 of the handle 21 no longer engages the head 89 of the linkage rod 23 and the bias spring 71 rotates the rod 41 counterclockwise, as seen in FIGS. 6 and 10, and the wheels 17 back into the wheel wells 39.

Figure 8:
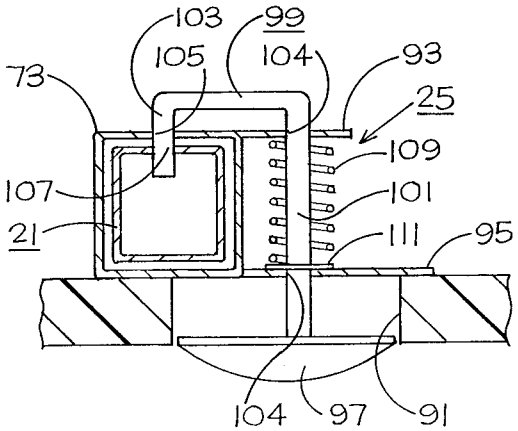
FIG. 8 is a schematic cross-sectional view taken along lines VIII—VIII of FIG. 5, showing the handle locking apparatus in the locked position.
Figure 9:
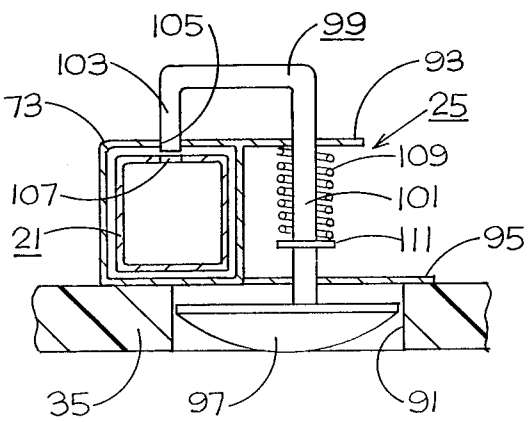
FIG. 9 is a schematic cross-sectional view similar to FIG. 8, but showing the handle locking apparatus in the unlocked position.

Referring to FIGS. 8 and 9, a handle locking apparatus 25 is provided to lock the handle and thus the wheels in either the stowed or the deployed position. A hole 91 is cut into the back wall 35 of the case portion 15 laterally of the handle housing 73. The housing 73 has two plates 93, 95 extending out over the hole 91. The plates 93, 95 are separated by the diameter of the housing 73. The hole 91 receives an actuating button 97 which has a hooked shaped member 99. The shank portion 101 of the hooked shaped member 99 extends through holes 104 in the housing plates 93, 95 and the hooked portion 103 is adapted to be received by holes 105, 107 formed through the wall of the housing 73 and the handle 21 when the handle 21 is stowed in the case and the holes 105 and 107 are aligned. A coil spring 109 is positioned around the shank portion 101 of the hooked shaped member 99 and between the two plates. One end of the spring 109 bears on the upper plate 93 and the other end of the spring bears on a flange 111 which is fixedly coupled to the shank portion 101 of the hooked shaped member. Thus, the spring 109 biases the hooked shaped member 103 in a locked position. When the hooked portion 103 is received by holes 105, 107 in both the housing and the handle, the handle 21 is locked in the stowed position. The handle 21 may be moved relative to the case by pressing inwardly on the button 97 to disengage the hooked portion 103 from the handle 21. The handle has another hole 113 for the deployed position. The handle 21 may be moved outward and locked in the deployed position by pressing inward on the button 91 and pulling it outward until hole 113 is aligned with hole 107. The handle 21 may be locked in this position by releasing the button 97 to allow the hooked position 103 to enter holes 107 and 113. In this position, the wheels 21 will be moved outward of the wheel wells 39 and locked in an operative position wherein a person may use the wheels 21 to roll the case on the floor or ground by grasping the outward extending handle.

In one embodiment the rods 23 and 41 and the handle components 21 and 73 may be formed of suitable metal.

The foregoing disclosure and the showings made in the drawings are merely illustrative of the principles of this invention and are not be to interpreted in a limiting sense.

I claim:

1. A transportable case of for carrying items:

a main wall having side walls extending therefrom forming a container, two of said side walls being located on opposite sides of said main wall, two spaced apart opening means formed through said main wall near one of said two side walls, means located near said one side wall for rotatably supporting an elongated rod means, said rod means having two opposite ends extending into said two opening means respectively, two arm means coupled to said two opposite ends of said rod means respectively and extending transversely from the axis of the rod means, two wheels rotatably coupled to said two arm means respectively, said rod means being rotatable to first and second positions to locate said two wheel means in said two opening means respectively for storage purposes and out of said two opening means respectively for use for rotatably supporting said case on the ground, floor, or the like, linkage arm means coupled to said rod means between said two opposite ends and extending transversely from the axis of said rod means, a linkage having a first end pivotally coupled to said linkage arm means and a second end extending toward the other of said two side walls, guide means located within the walls of said case, a tubular handle slideably coupled to said guide means for movement between inner and outer positions, said second end of said linkage extending into said tubular handle through a first end thereof, an opening formed through said other of said two side walls for receiving the other end of said tubular handle, in said inner position of said handle, a substantial portion of said handle being located within the walls of said case, in the outer position of said handle, the other end of said handle extends through said handle opening such that a substantial portion of said handle extends outwardly of the walls of said case, means located at said first end of said tubular handle for engaging said second end of said linkage for moving said linkage toward said other of said two walls when said handle is moved to said outer position for causing said rod means to be rotated toward said second position for moving said two wheels out of said two opening means respectively, handle locking means for releasably locking said handle in said inner position and in said outer position, and means for urging said rod means to said first position when said handle is in said inner position for maintaining said wheels into said two opening means for storage purposes.

2. The transportable case of claim 1, wherein said means for urging said rod means to said first position comprises a spring having a first end coupled to said rod means and a second end coupled to one of said walls.

3. Transportable case of claim 1, wherein said handle locking means comprises:

first and second spaced apart apertures formed through the wall of said tubular handle near its first and second ends respectively, pin means, and support means for supporting said pin means for movement into and out of said second and first apertures when said handle is located in said inner and outer positions respectively for releasably holding said handle in said inner and outer positions.

4. The transportable case of claim 2, wherein said handle locking means comprises:

first and second spaced apart apertures formed through the wall of said tubular handle near its first and second ends respectively, pin means, and support means for supporting said pin means for movement into and out of said second and first apertures when said handle is located in said inner and outer positions respectively for releasably holding said handle in said inner and outer positions.

5. The transportable case of claim 4, comprising:

a pin means receiving aperture formed through said main wall, said support means supports said pin means for movement through said pin means receiving aperture.

* * * * *